US006446466B1

(12) United States Patent
Headley

(10) Patent No.: US 6,446,466 B1
(45) Date of Patent: Sep. 10, 2002

(54) INTERCHANGEABLE JEWELRY SYSTEM WITH INVISIBLE COUPLING DEVICE

(76) Inventor: Theresa B. Headley, P.O. Box 33788, Indialantic, FL (US) 32903-0788

( * ) Notice: Subject to any disclaimer, the term of this patent is extended or adjusted under 35 U.S.C. 154(b) by 0 days.

(21) Appl. No.: 09/394,335

(22) Filed: Sep. 13, 1999

(51) Int. Cl.[7] ..... A44C 5/00

(52) U.S. Cl. ..... 63/3.1; 63/3; 63/29.1; 24/605; 24/683; 24/684

(58) Field of Search ..... 63/3, 3.1, 29.1; 24/605, 614, 683, 684, 685

(56) References Cited

U.S. PATENT DOCUMENTS 2,346,887 A * 4/1944 Winkler ..... 24/618
2,644,992 A * 7/1953 McFarland ..... 24/116 A
2,648,886 A * 8/1953 Prestinari et al. ..... 24/327
2,654,934 A * 10/1953 Armbruster ..... 24/519
3,168,768 A * 2/1965 Bohlinger et al. ..... 24/116 A
3,175,853 A * 3/1965 Gilbertson ..... 292/86
5,005,268 A * 4/1991 Hartmann ..... 24/652
5,305,617 A * 4/1994 Fontana ..... 63/3

* cited by examiner

*Primary Examiner*—Gary Estremsky
*Assistant Examiner*—Andrea Chop

(57) ABSTRACT

An interchangeable jewelry system based on a simple and secure two part coupling device which is a combination of a male prong containing a hook and a snap, and a specifically designed female soleplate having a curved substructure. The shape of this special soleplate guides the prong to a point at which it can be lifted to engage the hook, and rotated to engage the snap. The size and shape of the prong relative to the specific design of the soleplate structure prevents it from being disengaged while being worn. The elements of the coupling device are an integral part of, and incorporated into, the back sides of a wide variety of jewelry elements, resulting in a coupling invisible from the front or the sides of the assembled item of jewelry, the ultimate effect being that of an unalterable entity. All elements in a collection, having these same components, are interchangeable in a countless number of combinations.

5 Claims, 4 Drawing Sheets

INTERCHANGEABLE JEWELRY SYSTEM WITH INVISIBLE COUPLING DEVICE

BACKGROUND OF THE INVENTION

The present invention relates to a jewelry system with an invisible coupling device that provides convertibility. More specifically, it is designed for necklaces and bracelets, enabling the user to disengage the piece of jewelry and insert an ornamental piece or pieces, thereby transforming its appearance, and/or to insert or remove segments in order to alter its overall length. These same ornamental pieces may alternately be worn in combination with other elements such as earrings or brooches.

Convertibility is a highly desirable quality for expensive jewelry, allowing the wearer to own several pieces in one. A plain gold choker can be turned into an elegant necklace by adding a variety of center ornaments such as a gold coin or an ornamental piece with pearls or stones, which in turn, can be made more formal by adding more segments and stone-set inserts in any number of combinations. That same center ornament can be worn as a pendant with that same necklace or other necklaces, or with pearls in a large variety of positions and combinations, or in another piece of jewelry such as a bracelet, brooch, or earrings.

Jewelry designers have always recognized the advantages of multi-use jewelry, and have successfully created a multitude of such designs. Prior patents usually relate to small objects which can be used interchangeably as rings, earrings, and/or pendants, which can be suspended from a chain, and almost always have some sort of visible clamp, eye, hook, clasp, or aperture. Furthermore, the scope of their adaptability is generally very limited. U.S. Pat. No. 4,763,489 to Strong (1988) shows modular jewelry elements having visible eyelets and capture hooks integrally associated with their peripheral surfaces. U.S. Pat. No. 5,921,110 to Middendorff, et al. (1999) also shows a plurality of knobs and clips. This is an attractive design, but has limited application when used as a necklace, wherein it can only be suspended from a chain. Another example of segmented transformable jewelry is U.S. Pat. No. 5,865,042 to Cerqua (1999) which shows articles used mostly as rings and earrings, but having an eyelet that enables said article to be hung on a chain as a pendant. U.S. Pat. No. 4,655,054 to Roesch (1987) shows an interchangeable jewelry assembly comprised of an ornament with a fastening loop, and a serpentine fastening structure with an enlarged outboard end; an object which may be used as an earring, a brooch, or a necklace ornament, to be suspended as a pendant on a chain. Another example is U.S. Pat. No. 5,165,257 to Corenblith (1992), which shows a device with side walls protruding substantially on one element and perforations or elongated slots on the opposing pieces.

The basis of the present invention is a coupling device that is impossible to disassemble while it is being worn, preventing the accidental disengaging of its various elements. All prior patents of coupling devices and clasps are designed for the purpose of connecting the ends of jewelry on the wearer, and all are visible from the front. The following patents: U.S. Pat. No. 5,155,893 to Nussberger (1992); U.S. Pat. No. 4,924,562 to Pogharian (1990); U.S. Pat. No. 4,813,108 to Geldwerth (1989); U.S. Pat. No. 5,117,539 to Shrader, et al. (1992); U.S. Pat. No. 5,678,282 to Stewart (1997); and U.S. Pat. No. 5,774,957 to Kohl, et al. (1998) all show clasps that are designed to attach two ends of a jewelry article enabling the wearer to put it on and take it off. The present invention is designed for a different purpose, which is to invisibly and safely attach various elements in a variety of possible combinations, thereby creating a necklace or bracelet which, after assembling, can then be attached by a conventional clasp.

Although there are many attractive and clever prior patents for interchangeable jewelry designs, none of them has the appearance of a singular, unalterable entity. There is no other convertible jewelry system that offers the amount of versatility of the present invention, because this coupling device is internal, and accessible only from the reverse side of each piece, making it invisible from the front, and even from the sides. Each ornamental piece is completely smooth and finished on the face and on all sides, thus allowing an ornamental piece to be used in either the horizontal or vertical position, or even suspended as a pendant, giving every piece exceptional versatility, with multiple applications. There are no prior interchangeable jewelry systems that have no visible fastening structures such as loops, hooks, or apertures of some kind, and no prior systems that have a coupling device which cannot be accidentally disengaged while being worn.

BRIEF SUMMARY OF THE INVENTION

The principal object of the present invention is to provide a convertible system of jewelry with interchangeable parts, made possible by a coupling device that is invisible from the front, smooth and concealed from the back when engaged, and impossible to disengage while it is being worn, making it extremely secure.

This coupling device can only be used to remove and/or add jewelry elements. To disengage the coupling device, the linear segment must be rotated inward, to an angle of 115°, which is beyond the perpendicular. This position cannot be attained while the jewelry item is being worn on the body, making it completely secure. In order to wear the necklace/bracelet, it must be attached with a conventional clasp, only after the various pieces have been assembled with this coupling system.

This system allows a variety of linear elements, i.e., gold or platinum necklace and bracelet sections, strands of pearls, and/or strands of other organic or gemstone beads, together with an endless list of possible ornamental connectors.

In addition to the linear elements, this jewelry system also includes ornamental connecting pieces. All ornamental elements in a collection can be used with all linear elements, such as necklaces or bracelets. They may be plain and casual, such as a gold coin, or very elaborate and formal, made with a variety of precious stones and metals, in an unlimited number of combinations.

The basis of this system allows enormous versatility to the owner/wearer. For instance, a platinum necklace can be worn simply with a matching platinum connector or connectors, as a choker. It can alternately be worn with a yellow gold coin centerpiece and yellow gold ornamental connectors, totally transforming its appearance, and making it more adaptable in order to coordinate with other jewelry or even clothing with buttons of a different metal color.

A necklace or bracelet must use at least one connector as a coupling device, but it may be worn with multiple ornamental connectors in a variety of combinations. Ornamental connectors can also be used in combination with extra linear segments of said necklace to alter the length of same.

An oblong ornamental connector can be worn as a linear part of a gold or platinum necklace in the horizontal position, or it could be worn in the vertical position in the same necklace, or in a multiple-strand pearl, dog-collar style necklace, or it could be suspended as a pendant from either one. It could even be suspended as a pendant from another ornamental connector.

An ornamental connector can also be used with a bracelet. A clock can also be an ornamental centerpiece, transforming a braclet into a watch.

Ornamental connectors can be used exclusive of this necklace/bracelet system in a variety of brooches, and/or earrings, providing an even greater spectrum of applications for these ornamental elements.

These jewelry elements can be transformed in order to adapt to various apparel by changing or mixing the color of the metal, or changing or mixing the the color of the gem stones. The formality can be adjusted according to apparel or occasion, and the actual structure of the design can be transformed according to the neckline of the dress, making the owner/wearer the ultimate designer.

BRIEF DESCRIPTION OF THE SEVERAL VIEWS OF THE DRAWINGS

The drawings incorporated herein illustrate the embodiments of the present invention. Due to the nature of the invention, the drawings of FIGS. 1–8 are enlarged for clarity.

NUMERICAL REFERENCE ON DRAWINGS:

| | | | |
|---|---|---|---|
| 10 | soleplate | 32 | prong |
| 12 | backplate of ornamental element | 34 | spine |
| 14 | large aperture | 36 | hook |
| 16 | small aperture | 38 | snap |
| 18 | catch bar | 40 | stop |
| 20 | substructure of soleplate | 42 | element of jewelry attached to prong |
| 22 | beginning of curved substructure | 44 | soleplate with narrow aperture |
| 24 | curved section | 46 | spine of narrow prong |
| 48 | circle | | |

-continued

| | | | |
|---|---|---|---|
| 26 | nadir | 50 | inside curve of hook |
| 28 | angled section of substructure | 52 | pair of prongs |
| 30 | terminus of soleplate | 54 | pair of soleplates |
| | | 56 | special connector |

DETAILED DESCRIPTION OF THE INVENTION

The drawings herewith represent the present invention, which a coupling device consisting of two singular components that, when united, form a simple and secure male-female type connection. Due to the diminutive nature of the invention, FIGS. 1–8 are enlarged for clarity.

Figure 1A:
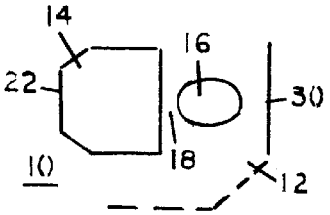
FIGS. 1A–C are three different views of the soleplate, which is the female element of this two part coupling device.

FIG. 1A shows a plan of the female component, which is a soleplate 10, specifically designed to be an integral part of the backplate of an ornamental piece of jewelry 12. Said soleplate has, on its faceplate, a large aperture 14, a small aperture 16, and a space between said apertures, which is a catch bar 18. The terminus 30 of the soleplate is exactly aligned with the edge of the ornamental piece of jewelry 12, of which it is an integral part.

Figure 1B:
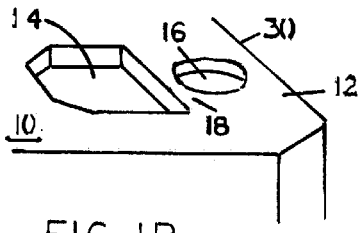

FIG. 1B is a perspective view of the soleplate of FIG. 1A.

Figure 1C:
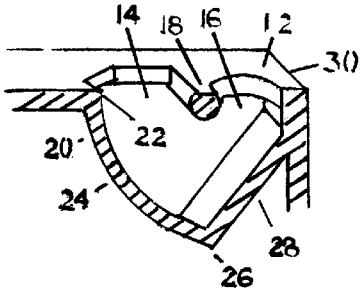

FIG. 1C is a cross-section view of the soleplate shown in FIGS. 1A & B, which illustrates the specifically designed substructure 20, which starts at the leading edge 22 (and FIG. 1A) of the large aperture 14, includes a curved section 24, the nadir of a v-shaped section at the bottom of said substructure 26, and an angled linear segment 28 connecting the nadir to the terminus end of said soleplate 30.

Figure 2A:
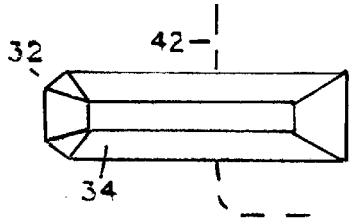
FIGS. 2A–C are three different views of the prong, which is the male element of the coupler.

FIG. 2A is a plan of the male component, which is a prong 32 with a beveled spine 34, which is permanently affixed to a piece of jewelry 42.

Figure 2B:
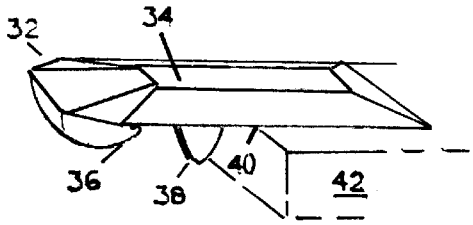

FIG. 2B is a perspective view of the prong of FIG. 2A, showing a beveled spine 34, and also illustrating a hook 36, a snap 38, and a stop 40 on its underside, said stop usually being the vertical edge of the jewelry segment attached thereto 42.

Figure 2C:
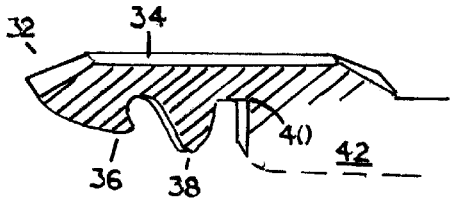

FIG. 2C is a cross-section view of the prong of FIG. 2A & B.

Figure 3:
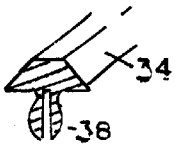
FIG. 3 is a cross-section frontal view of the prong in FIGS. 2A–C illustrating the snap.

FIG. 3 illustrates a cross-section frontal view of the prong of FIGS. 2A–C, showing that the spine of the prong 34 is wider than the snap 38, and that said snap is split for flexibility.

The snap 38 must be very slightly wider than the width of the narrow aperture (FIGS 1A–C & 4A 16), into which it fits.

Figure 4A:
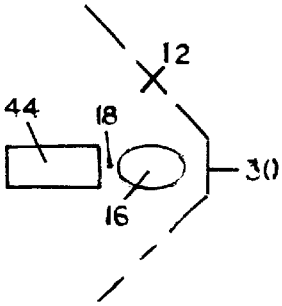
FIGS. 4A & B show a narrow version of the soleplate in FIG. 1C, and a narrow version of the prong in FIG. 2C.
Figure 4B:
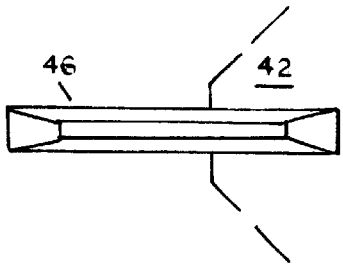

FIGS. 4A & 4B illustrate plans of a narrower version of the two elements of the present invention. FIG. 4A shows a soleplate with an identical small aperture 16 of the soleplate of FIG. 1A, but having a narrower large aperture 44. FIG. 4B is a plan of a narrow version of the prong of FIG. 2A, the only difference being the width of the spine 46,(FIG 2A 34). All other dimensions are identical.

Figure 5:
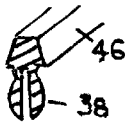
FIG. 5 is a cross-section of the narrow version of the prong, illustrating its snap.

FIG. 5 is a cross-section frontal view of the narrow prong of FIG. 4B, illustrating a snap identical to the snap of FIG. 3. The spine 46 of a narrow prong must be at least as wide as its snap 38, in order to conceal the small aperture (FIGS. 1A–C & FIG. 4A 16) when in a coupled position (FIG. 7).

Figure 6A:
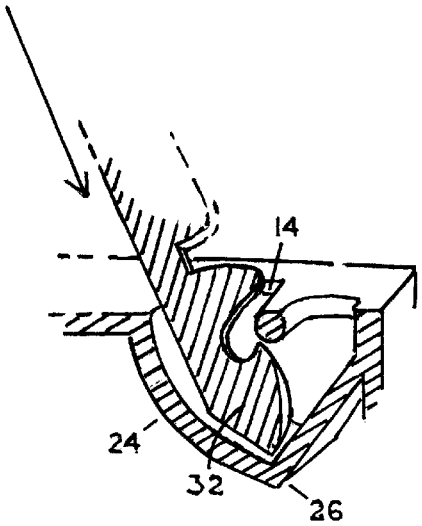
FIGS. 6A–C are cross-section views showing the interconnection of the prong and the soleplate.
Figure 6B:
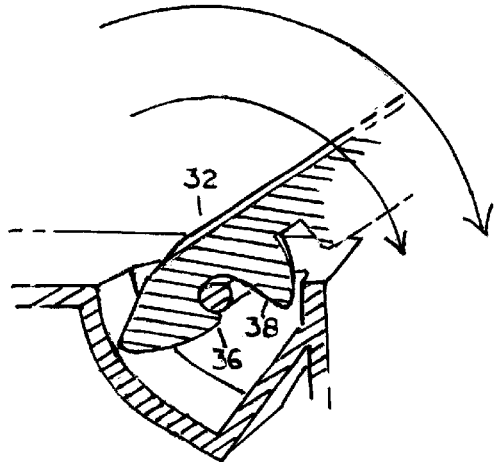
Figure 6C:
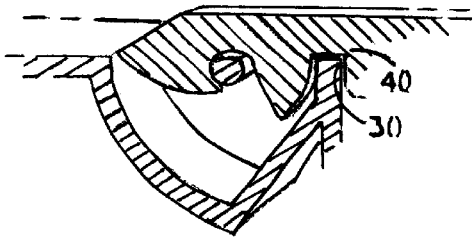

FIGS. 6A–6C are cross-section views which show the interconnection of these two components, and demonstrate how the specific design of the soleplate, relative to the specific design of the prong, creates a secure union. When the prong 32 is inserted into the large aperture of the soleplate (FIG. 6A) 14, the curved substructure of the soleplate 24 guides the prong 32 to the nadir 26, at which point said prong can be rotated (FIG. 6B) to engage the hook 36, and rotated further to engage the snap 38. FIG. 6C shows the coupling device interlocked. In this position the stop 40 on the prong abuts the terminus of the soleplate 30, thereby preventing the prong from sliding forward, locking the two elements together.

Figure 7:
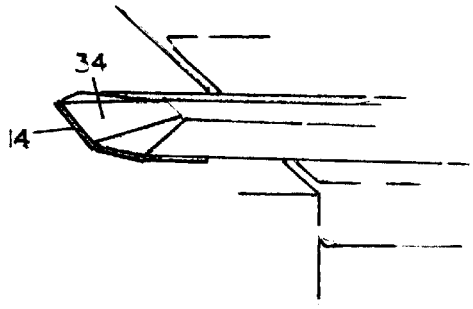
FIG. 7 is an illustration of the prong and soleplate in a coupled position.

FIG. 7 is a perspective view of these two principal elements in the coupled position, the spine of the prong 34, being the same width and shape of the large aperture of the soleplate 14, and larger than the small aperture (now invisible), completely concealing the works and leaving a flush, smooth appearance when in the closed position.

Figure 8A:
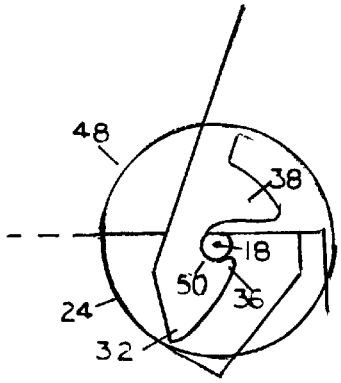
FIGS. 8A–D are elevations of the prong and the soleplate interconnected, with a circle superimposed over views 8A & B to demonstrate the theory behind the particular design, and the angle which they must achieve in order to uncouple.
Figure 8B:
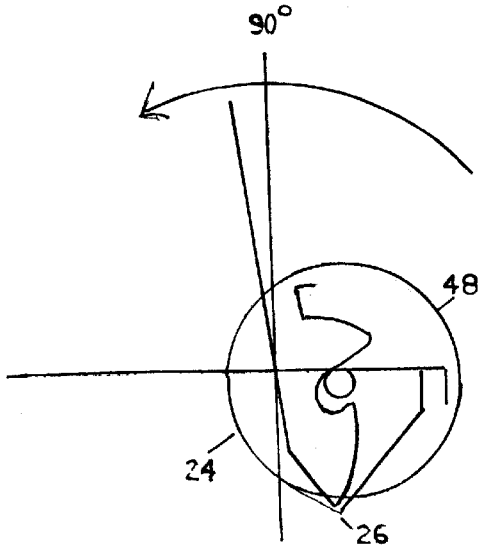
Figure 8C:
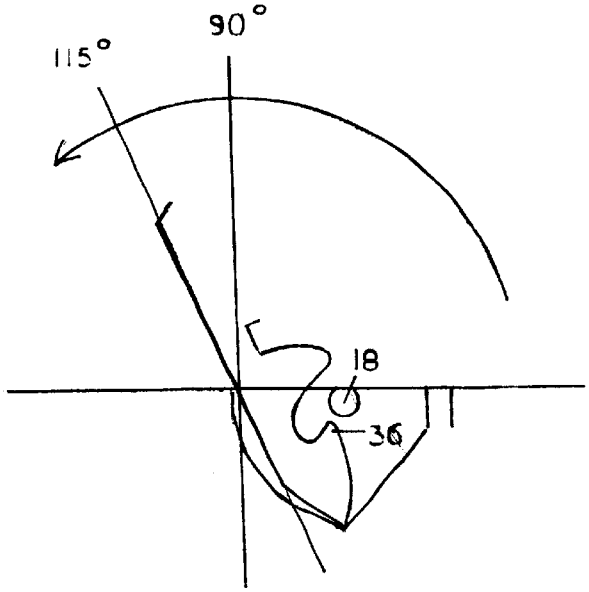
Figure 8D:
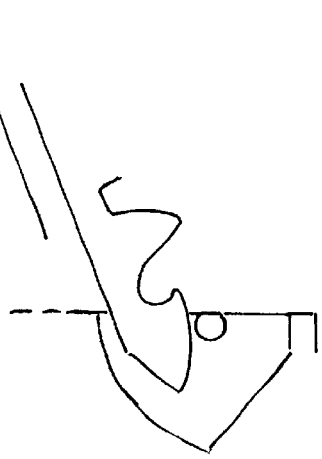

FIGS. 8A & B are elevations which exhibit a circle 48 superimposed over the components to exemplify the fundamental theory that establishes the secure union of these two principal elements. Together they form a segment of a circle (FIG. 8A), the curved structure of the soleplate 24 forming the circumference, the section of the prong between the point 32 and the inside curve of the hook 50, representing the radius, with the catch bar 18 being the center of said circle. When the snap 38 is disengaged, the curved design of the soleplate (circumference) 24 prevents the prong (radius) 32 from sliding forward, thereby preventing the disengaging of the hook 36. In order to uncouple the individual elements (FIG. 8B), the prong must be rotated to an angle beyond the perpendicular, where it can reach the nadir 26, which is beyond the circumference 24, 48, and further to 115° (FIG. 8C) allowing the hook 36 to clear the catch bar 18, and to slide the prong out of the aperture (FIG. 8D). Hence, the safety feature; because this rotation is inward, toward the body, this position cannot be attained while being worn.

Figure 9A:
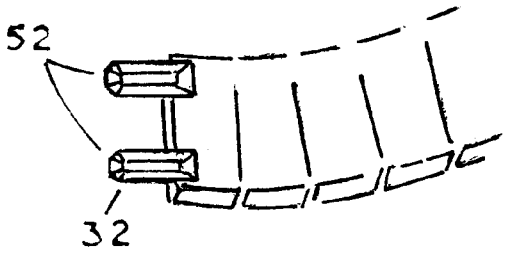
FIGS. 9A & B are examples of applications of the prongs of the sent invention.
Figure 9B:
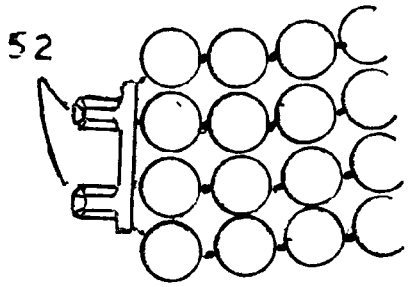

FIGS. 9A & B show examples of practical applications of the present invention. In this example the wider version of the prong is used in pairs for strength and stability. All linear components such as pearl or bead strands and necklace or bracelet sections in a collection must have identical prongs 52, 32.

All ornamental connectors in a collection (FIGS. 10 & 11) must have soleplates with identical receptacles 54, so that every linear component fits into every ornamental element, thereby making all pieces interchangeable.

Figure 10:
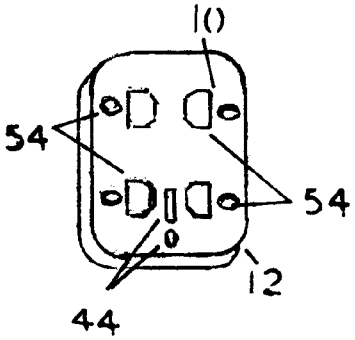
FIG. 10 is the back view of an example of an ornamental element having soleplates of the present invention incorporated into the backplate of same.

FIG. 10 illustrates an example of the back side of an ornamental element, containing two pairs of soleplates with wide apertures 54 and one version of a soleplate with a narrow aperture 44, all incorporated into, and an integral part of, the back plate of said ornamental element 12.

Figure 11:
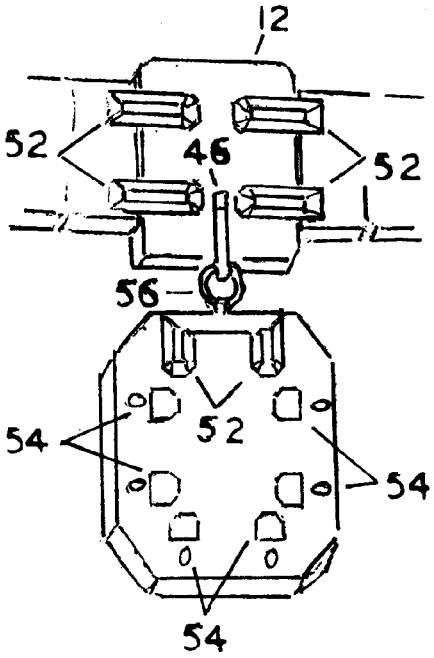
FIG. 11 is the back view of an example of one possible combination elements using a special connecting piece, all shown in the coupled position.

FIG. 11 shows an example of a possible combination of elements, using the same ornamental piece 12 of FIG. 10, with all soleplates of that piece being engaged with male prongs 52 & 46.

Special connecting pieces with prongs on both ends may be used to connect two ornamental connectors. An example of such a connector is illustrated in FIG. 11 56, which has a pair of wide prongs 52 on one end and a single narrow prong 46 on the other.

Frontal views of linear elements and ornamental connectors are not relevant to the present invention, and are not shown. All prongs and all receptacles are on the reverse surface of each jewelry element, and are invisible from the front or any of the sides of said ornamental elements.

The forgoing descriptions of the embodiments of the present invention have been presented to illustrate the objectives described herein. It is not intended to limit the invention to the precise form disclosed but to cover the invention broadly. Those skilled in the art may find many modifications, variations, and adaptations thereof, within the scope of the present invention.

I claim as my invention:

1. A jewelry element having two ends and having a secure non visible two part male-female coupling device for connecting said ends of the jewelry element, said coupling device comprising:

a male component comprising an elongated prong having a beveled spine on a surface thereof, said prong comprising a hook, a snap, and a stop on an underside of said prong, said prong being permanently affixed to and extending from one of said ends of said jewelry element, said stop being formed of a vertical edge at said one of said ends of said jewelry element; and a female component comprising a soleplate, said soleplate having a terminus at one edge, said soleplate having two apertures, one of said apertures being the same size and shape as said prong and having a leading edge, said leading edge being located opposite said terminus, said one of said apertures being larger than the other aperture of said two apertures, said other of said apertures calibrated to accommodate said snap, said apertures being spaced apart by a catch bar, said soleplate further comprising a specifically designed curved substructure which forms a segment of a circumference of a circle, said segment of a circle beginning at said leading edge of said one of said apertures, said catch bar being located at the center of said segment of a circle, said curved substructure extending beyond said segment of a circle to a nadir, said nadir forming a V-shape at a bottom of said substructure, said soleplate being a permanent integral part of said other of said ends of said jewelry element, said terminus being formed of an outside edge of said other of said ends of said jewelry element.

2. The jewelry element and coupling device as described in claim 1, wherein said hook has an inside and an outside, and said prong has an end, and the distance between said end of said prong and the inside of said hook is equal to the distance between the curved substructure and said catch bar, and the distance between the end of said prong and the outside of said hook is greater than the distance between the curved substructure and said catch bar, but slightly shorter than the distance between the nadir and the catch bar.

3. The jewelry element and coupling device as described in claim 1, wherein said prong has an end, and the distance between the end of said prong and said stop is equal to the distance between the leading edge of said one of said apertures and the terminus.

4. The jewelry element and coupling device as described in claim 1, wherein said prong has an end and said prong is capable of being inserted into said one of said apertures until the end of said prong reaches said nadir, whereupon said prong can be rotated to engage the snap to couple said prong to said soleplate, the stop abutting the terminus preventing the prong from slipping forward, thereby locking the prong and soleplate in place.

5. The jewelry element and coupling device as described in claim 1, whereby when the prong and soleplate are connected to one another and are locked in place, the prong can be lifted to disengage the snap whereupon the hook cannot be disengaged from the catch bar until the prong is rotated to an angle beyond the perpendicular with respect to a top surface of the soleplate, allowing the prong to reach the nadir, whereupon the hook can clear the catch bar, and can be rotated further to an angle approximately 115 degrees with respect to a top surface of the soleplate, and can then be withdrawn from the soleplate, thereby disengaging the prong from the soleplate.

* * * * *